US007968797B2

(12) United States Patent
Williams

(10) Patent No.: US 7,968,797 B2
(45) Date of Patent: Jun. 28, 2011

(54) MODULAR ELECTRIC FENCE SYSTEM AND ASSEMBLY

(76) Inventor: James L. Williams, Kuna, ID (US)

( * ) Notice: Subject to any disclaimer, the term of this patent is extended or adjusted under 35 U.S.C. 154(b) by 622 days.

(21) Appl. No.: 12/134,628

(22) Filed: Jun. 6, 2008

(65) Prior Publication Data

US 2009/0301759 A1 Dec. 10, 2009

(51) Int. Cl.
*H01B 17/00* (2006.01)

(52) U.S. Cl. ..... 174/154; 174/158 F; 174/138 G; 174/168; 174/163 R; 258/72; 256/10

(58) Field of Classification Search ..... 174/154, 174/158 F, 138 G, 161 F, 163 R, 168, 158 R; 248/72; 256/10
See application file for complete search history.

(56) References Cited

U.S. PATENT DOCUMENTS

| | | | | |
|---|---|---|---|---|
| 3,652,780 A | | 3/1972 | Wilson | 174/45 |
| 3,820,758 A | * | 6/1974 | Berg et al. | 256/10 |
| 4,049,905 A | * | 9/1977 | Maranell | 174/163 F |
| 4,263,477 A | | 4/1981 | Wilson, Sr. | 174/173 |
| 4,599,488 A | | 7/1986 | Wilson, Jr. | 174/158 |
| 4,866,218 A | | 9/1989 | Wilson, Jr. | 174/158 |
| 6,489,569 B1 | | 12/2002 | Thomson | 174/154 |
| 6,563,055 B1 | | 5/2003 | Burdick | 174/158 |
| 6,872,892 B1 | | 3/2005 | Burdick | 174/158 |
| 6,960,728 B1 | | 11/2005 | Halderman | 174/158 |
| 7,178,789 B1 | | 2/2007 | Lehmann | 256/47 |

* cited by examiner

*Primary Examiner* — Dhiru R Patel
(74) *Attorney, Agent, or Firm* — Holland Law Office P.L.L.C.

(57) ABSTRACT

A modular insulator system and assembly for attaching a conductor to a support member. The modular insulator assembly includes an insulator body attachable to a support member. A conductor retainer is attachable to the insulator body in a manner that forms a conductor passage between the conductor retainer and the insulator body. The modular insulator system includes an insulator body selected from a top-mount insulator body, a support passage insulator body, an insulator body including an extended neck, a surface mount insulator body and a combination surface/T-post mount insulator body the insulator body attachable to the support member and a conductor retainer selected from a group of conductor retainers including a bare conductive wire retainer, a narrow gage conductive tape retainer and a wide gage conductive tape retainer, the selected insulator body attachable to a support member and the selected conductor retainer attachable to the selected insulator body.

14 Claims, 16 Drawing Sheets

30A
30B
30C
31
32A
32B
33A
33B
35A
35B
35C
35D
36A
36B
50
51
53A
53B
53C
53D
58
60
61
63A
63C
63D
68
70
71
73A
73B
78

MODULAR ELECTRIC FENCE SYSTEM AND ASSEMBLY

FIELD OF THE INVENTION

The present invention relates in general to electric fencing and more particularly to a modular insulator assembly for supporting a conductor relative to a post or other structure.

BACKGROUND

Devices and fixtures for mounting a conductor to a fence post and other structure are generally known. Some devices are adapted for connection to posts having a particular configuration, for instance, U.S. Pat. No. 6,960,728 to Halderman, U.S. Pat. No. 6,563,055 to Burdick and U.S. Pat. No. 3,652,780 to Wilson. Others are adapted or are otherwise directed to supporting a conductor having a particular configuration relative to a post or other structure, for instance U.S. Pat. No. 7,178,789 to Lehmann, U.S. Pat. No. 6,960,728 to Halderman U.S. Pat. No. 6,872,892 to Burdick, U.S. Pat. No. 6,563,055 to Burdick, U.S. Pat. No. 6,489,569 to Thomson, U.S. Pat. No. 4,599,488 to Wilson, Jr., U.S. Pat. No. 4,263,477 to Wilson, Sr. and U.S. Pat. No. 3,652,780 to Wilson are directed to insulators that attach a wire type conductor to a post or other structure, while at least one other invention is directed to converting an insulator adapted to support a wire type conductor to support a conductive tape type conductor. See U.S. Pat. No. 4,866,218 to Wilson, Jr.

Inasmuch as a variety of conductor types and sizes are available, a supplier may find that a growing inventory of insulators is required to accommodate every type of electric fence product available and the various types of posts or other support members that an electric fence user may employ with any given insulator.

Advantage may therefore be found in providing a modular insulator system for connecting a variety of conductors to a variety of fence posts or other support members. Advantage may also be found in providing a modular insulator system that allows a supplier of electric fence products to reduce the inventory required to service an end user.

One object of the present invention therefore is to provide a modular insulator system that allows a supplier or user of electric fence products to reduce the inventory required to adapt to a system to different conductors and/or support members. Another object of the present invention is to provide a modular insulator system that allows the end user to repair, replace, modify or adapt an electric fence system to different support members and conductors more easily and at a lower cost of inventory. Another object of the present invention is to provide a modular insulator system for connecting a variety of conductors to a variety of fence posts or other support members.

SUMMARY OF THE INVENTION

The present invention is directed to a modular insulator system and assembly for attaching a conductor to a support member. The modular insulator assembly includes an insulator body that is attachable to a support member. A conductor retainer is attachable to the insulator body in a manner that forms a conductor passage between the conductor retainer and the insulator body. The modular insulator system includes an insulator body selected from a top-mount insulator body, a support passage insulator body, an insulator body including an extended neck, a surface mount insulator body and a combination surface/T-post mount insulator body the insulator body attachable to the support member and a conductor retainer selected from a group of conductor retainers including a bare conductive wire retainer, a narrow gage conductive tape retainer and a wide gage conductive tape retainer, the selected insulator body attachable to a support member and the selected conductor retainer attachable to the selected insulator body to form a conductor passage between the conductor retainer and the insulator body.

According to a preferred embodiment of the invention, the insulator body may be adapted to attach to one of a variety of electric fence support members, for instance one insulator body is adapted for attachment to a relatively flat or gently curving surface, square or round wood posts, while a second insulator body is adapted for attachment to a post having a generally T-shaped cross-section common to steel stake fencing posts and rod of various diameters. Alternately the second insulator may be attached to a post having a generally circular cross-section.

Each insulator body includes a first surface adapted for placement against a relatively flat or gently curving surface. Each insulator body also includes some means for allowing the insulator body to be held at a substantially constant position with regard to the electric fence support member. For example an aperture may be formed through the insulator body, through which a nail, screw or other hardware may be placed to affix the insulator body to a wood post or other structure. Alternately the means for allowing the insulator body to be held at a substantially constant position with regard to the electric fence support member may be configured as aperture formed through the insulator body, through which the electric fence support member itself may be inserted.

DETAILED DESCRIPTION

Figure 1:
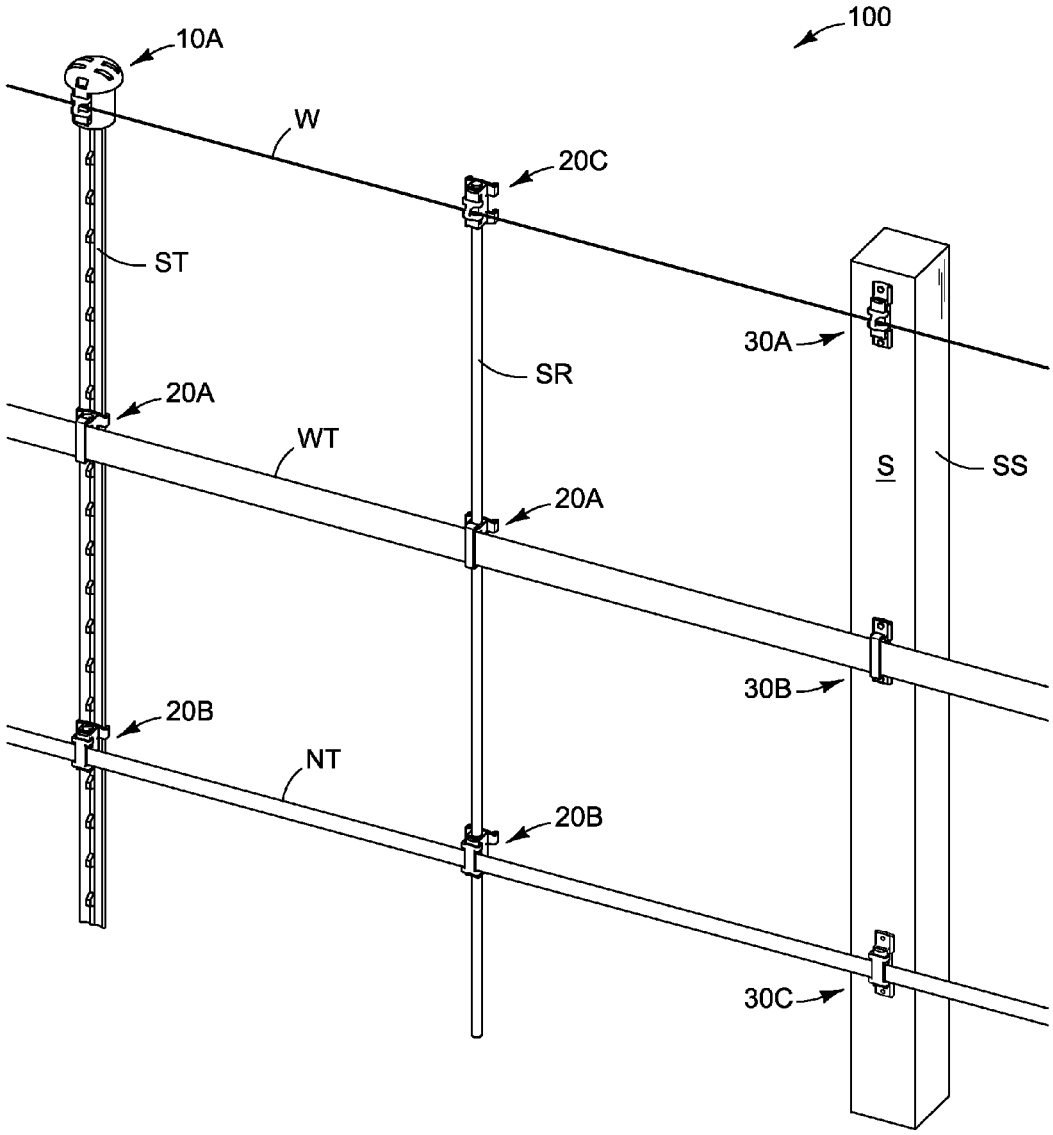
FIG. 1 is a perspective representation of a modular insulator assembly system for attaching a conductor to a support member according to the present invention.

FIG. 1 shows modular insulator assembly system 100 including various embodiments of the modular insulator assembly of the present invention. FIG. 1 shows modular insulator assembly 10A attached at an upper end of support member ST, which in this case is a steel T-post. Modular insulator assembly 10A is adapted to provide an insulated attachment of conductive wire W to support member ST. FIG. 1 also shows modular insulator assembly 20A which is attached midway along a length of support member ST, which is a steel fence post having a "T" cross-section. Modular insulator assembly 20A is also shown attached midway along a length of support member SR, which is a rod having a circular cross-section. Modular insulator assembly 20A adapted to provide an insulated attachment of wide gage conductive tape WT to either support member ST or support member SR.

FIG. 1 also shows modular insulator assembly 20B is attached along a length of support member ST as well as along a length of support member SR. Modular insulator assembly 20B is adapted to provide an insulated attachment of narrow gage conductive tape NT to either support member ST or support member SR.

Modular insulator assembly 20C is shown attached near an upper end of support member SR. Modular insulator assembly 20C is adapted to provide an insulated attachment of conductive wire W to support member SR.

FIG. 1 also shows modular insulator assembly 30A attached near an upper end of support member SS, which in this case is a post having a surface S upon which modular insulator assembly 30A is mounted. Modular insulator assembly 30A is adapted to provide an insulated attachment of conductive wire W to support member SS. FIG. 1 also shows modular insulator assembly 30B surface mounted midway along a length of support member SS and adapted to provide an insulated attachment of wide gage conductive tape WT to support member SS. Lastly, FIG. 1 also shows modular insulator assembly 30C attached near to surface S of support member SS. Modular insulator assembly 30C is adapted to provide an insulated attachment of narrow gage conductive tape NT.

Figure 2:
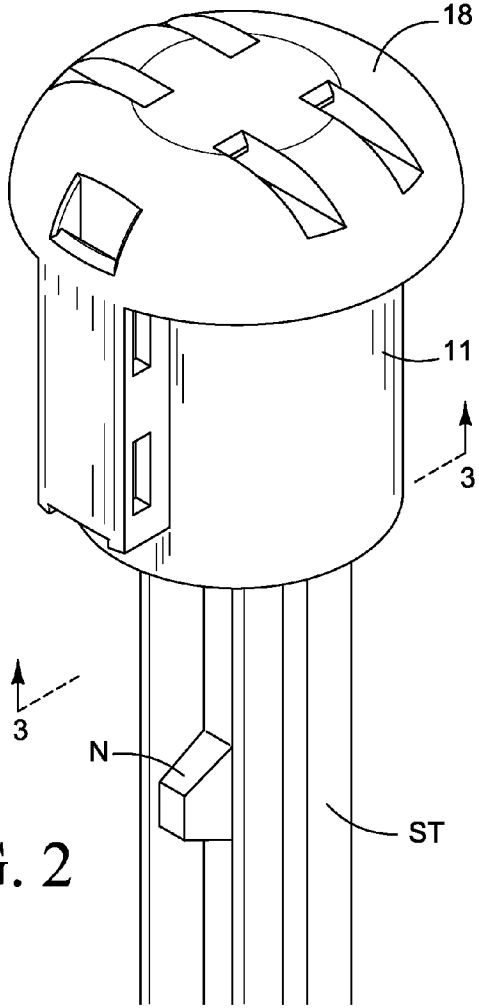
FIG. 2 is a perspective representative view of a top-mount insulator body according to the present invention.

FIG. 2 shows top-mount insulator body 11 mounted to an upper end of support member ST. AS shown in FIG. 2, top-mount insulator body 11 includes crown 18. The configuration of top-mount insulator body 11 provides protection against animals impaling themselves on a bare end of a support member.

Figure 3:
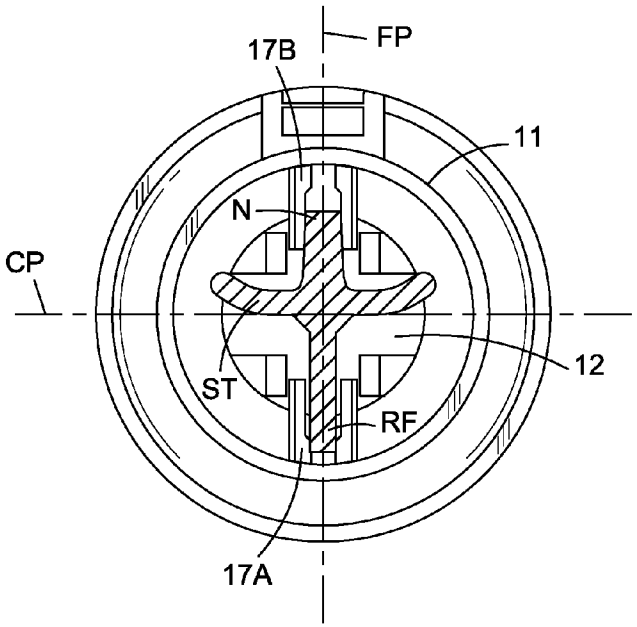
FIG. 3 is a bottom representative view of a top-mount insulator body according to the present invention.

FIG. 3 is a bottom view showing top-mount insulator body 11. Top-mount insulator body 11 includes support member aperture 12 adapted for placement on an upper end of support member ST. More particularly, support member aperture 12 is defined in part by first channel 17A configured to slidingly engage rear flange RF and second channel 17B configured to slidingly engage nub N of support member ST. It will be noted that FIG. 3 shows first and second channels 17A and 17B, and therefore rear flange RF and nub N of support member ST when top-mount insulator body 11 is mounted to an upper end of support member ST, lying along flange plane FP. Conductor plane CP lies perpendicular to flange plane FP.

Figure 5:
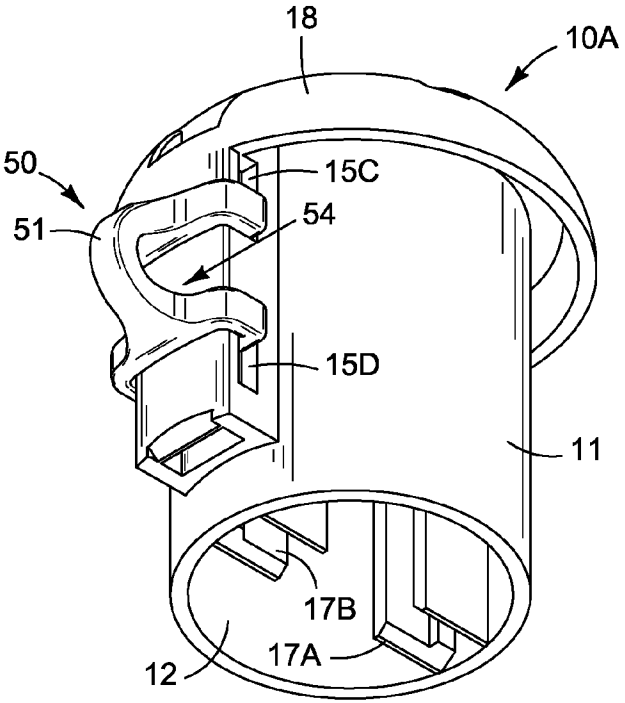
FIG. 5 is a perspective representative view of a modular insulator assembly according to the present invention.
Figure 4:
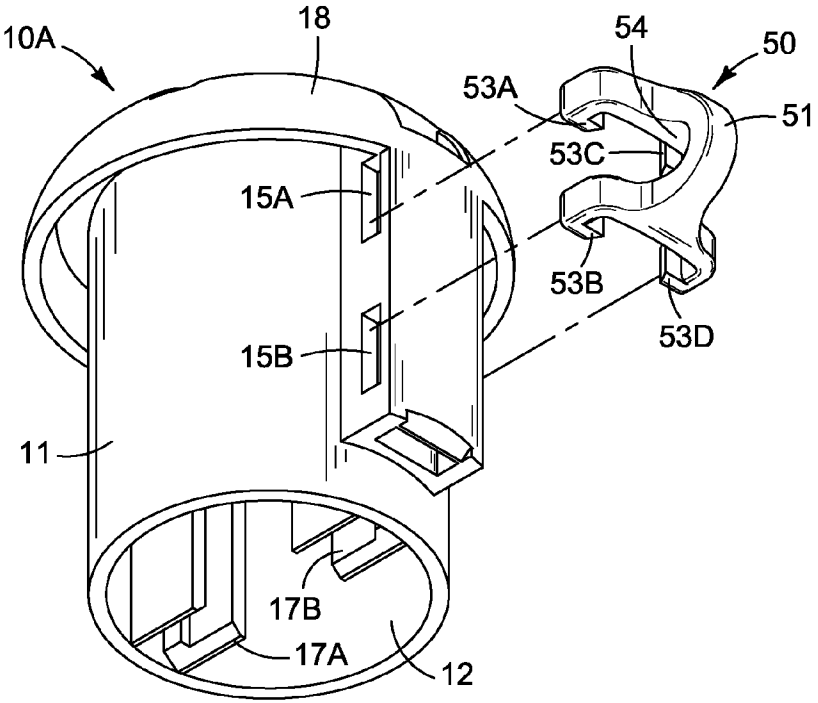
FIG. 4 is a perspective representative view of a modular insulator assembly according to the present invention.

FIGS. 4 and 5 show modular insulator assembly 10A including top-mount insulator body 11 and wire conductor retainer 50. In a preferred embodiment crown portion 18 is formed at and defines the uppermost portion of top-mount insulator body 11. As shown in FIGS. 4 and 5, top-mount insulator body 11 includes support member aperture 12. Support member aperture 12 is defined in part by first channel 17A and second channel 17B. First side retainer engaging slots 15A and 15B, (shown in FIG. 4), and second side retainer engaging slots 15C and 15D, (shown in FIG. 5), are formed in top-mount insulator body 11. FIG. 5 shows wire conductor retainer 50 attached to top-mount insulator body 11. More particularly, retainer fingers 53A and 53B have engaged first side retainer engaging slots 15A and 15B, (shown in FIG. 4), and retainer fingers 53C and 53D, (shown in FIG. 5), have engaged second side retainer engaging slots 15C and 15D, (shown in FIG. 5), to secure retainer body 51 to top-mount insulator body 11. Attachment of retainer body 51 to top-mount insulator body 11 as shown in FIG. 5 creates conductor passage 54 formed between retainer body 51 and top-mount insulator body 11. Conductor passage 54 is configured for passage of conductive wire W as seen in FIG. 1.

Figure 7:
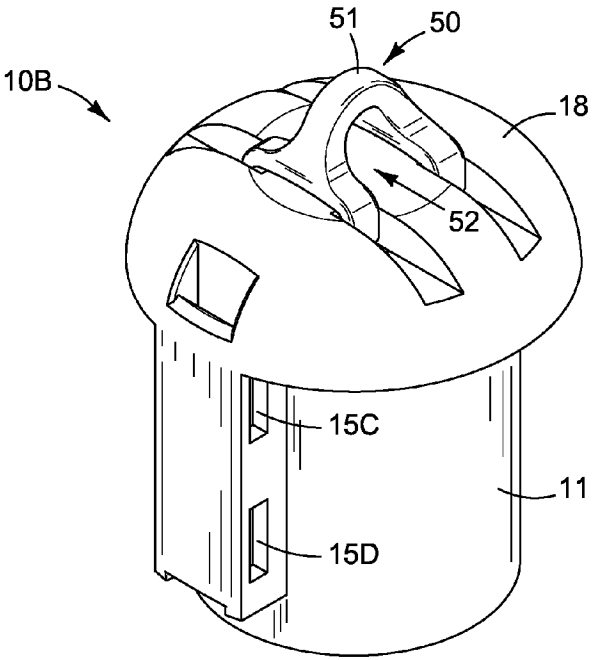
FIG. 7 is a perspective representative view of a modular insulator assembly according to the present invention.
Figure 6:
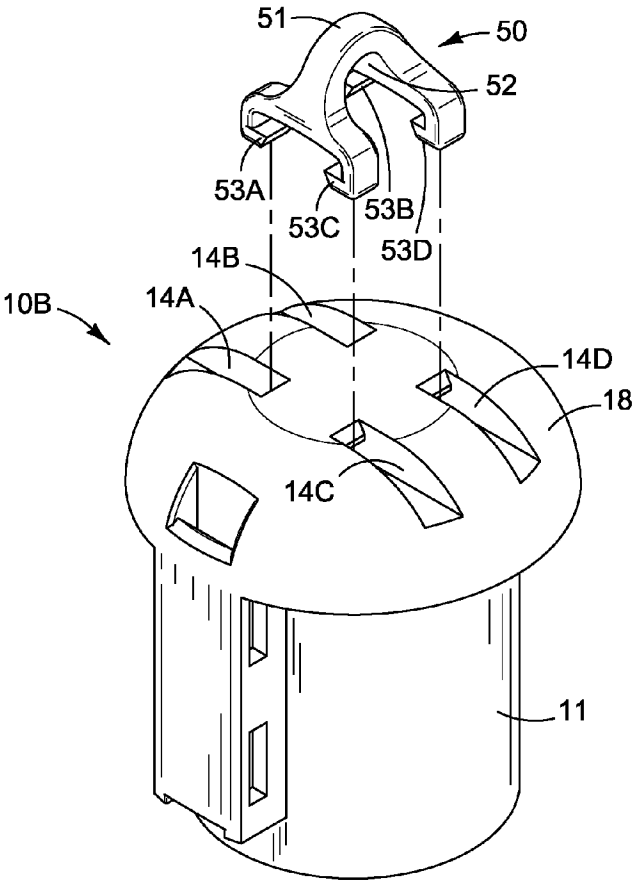
FIG. 6 is a perspective representative view of a modular insulator assembly according to the present invention.

FIGS. 6 and 7 show modular insulator assembly 10B including top-mount insulator body 11 and wire conductor retainer 50. Crown portion 18 is formed at and defines the uppermost portion of top-mount insulator body 11. Retainer engaging detents 14A, 14B, 14C and 14D are formed in crown 18. Wire conductor retainer 50 includes retainer body 51. Retainer body 51 includes a plurality of retainer fingers 53A, 53B, 53C and 53D. FIG. 7 shows wire conductor retainer 50 attached to top-mount insulator body 11. More particularly, retainer fingers 53A, 53B, 53C and 53D, (shown in FIG. 6), have engaged retainer engaging detents 14A, 14B, 14C and 14D, (shown in FIG. 6), to secure wire conductor retainer 50 to crown portion 18 of top-mount insulator body 11. The combined configuration creates conductor passage 52 formed between retainer body 51 and top-mount insulator body 11. Conductor passage 52 is configured for passage of conductive wire W which may include a bare wire, a high tensile wire, polywire or electric rope or braid up to approximately 1 centimeter, (⅜ inch), diameter.

Figure 9:
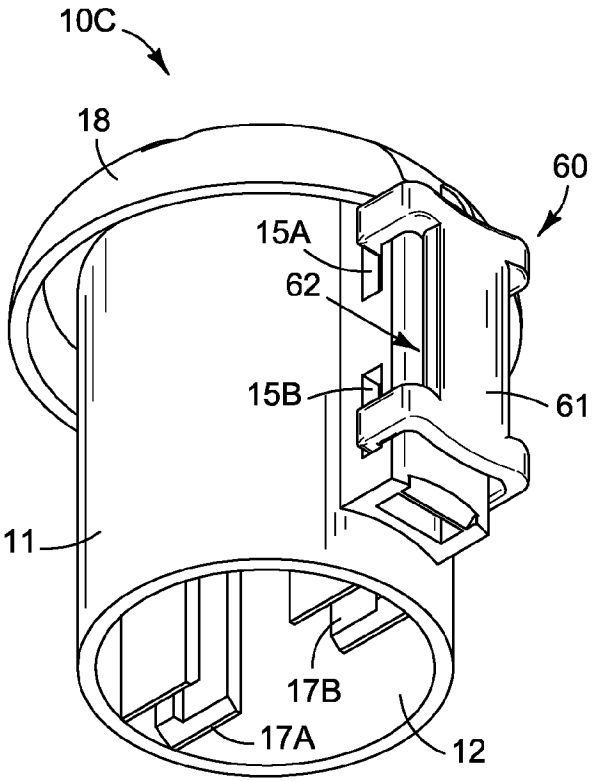
FIG. 9 is a perspective representative view of a modular insulator assembly according to the present invention.
Figure 8:
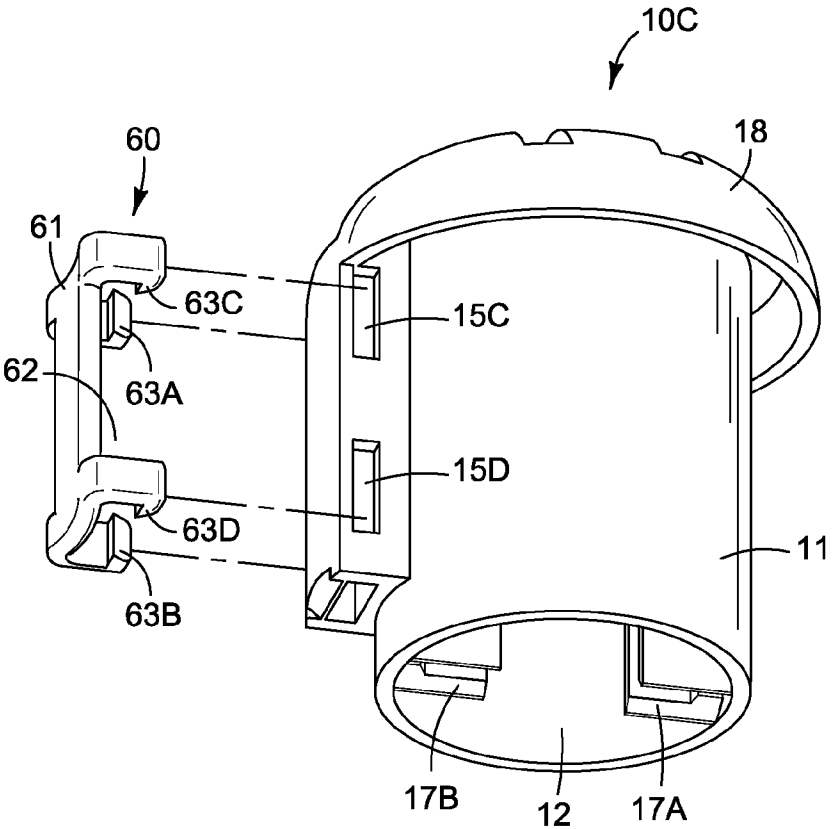
FIG. 8 is a perspective representative view of a modular insulator assembly according to the present invention.

FIGS. 8 and 9 show modular insulator assembly 10C including top-mount insulator body 11 and narrow gage tape conductor retainer 60. As shown in FIGS. 8 and 9, top-mount insulator body 11 includes support member aperture 12. Support member aperture 12 is defined in part by first channel 17A and second channel 17B. Crown portion 18 is formed at and defines the uppermost portion of top-mount insulator body 11. First side retainer engaging slots 15A and 15B, (shown in FIG. 9), and second side retainer engaging slots 15C and 15D, (shown in FIG. 8), are formed in top-mount insulator body 11. FIG. 9 shows narrow gage tape conductor retainer 60 attached to top-mount insulator body 11. More particularly, first side fingers 63A and 63B, (shown in FIG. 8), have engaged first side retainer engaging slots 15A and 15B, (shown in FIG. 9), and second side fingers 63C, and 63D, (shown in FIG. 8), have engaged second side retainer engaging slots 15C and 15D, (shown in FIG. 9), to secure retainer body 61 to top-mount insulator body 11. Attachment of retainer body 61 to top-mount insulator body 11 as shown in FIG. 9 creates conductor passage 62 formed between retainer body 61 and top-mount insulator body 11. Conductor passage 62 is configured for passage of a narrow gage conductive tape NT, (shown in FIG. 1), which is typically configured having a width of about 2.54 centimeters, (one inch).

Figure 11:
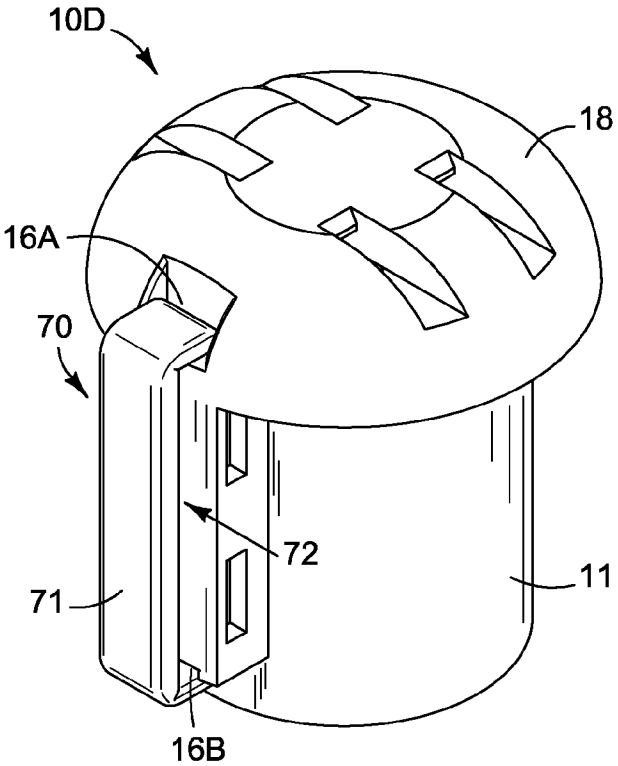
FIG. 11 is a perspective representative view of a modular insulator assembly according to the present invention.
Figure 10:
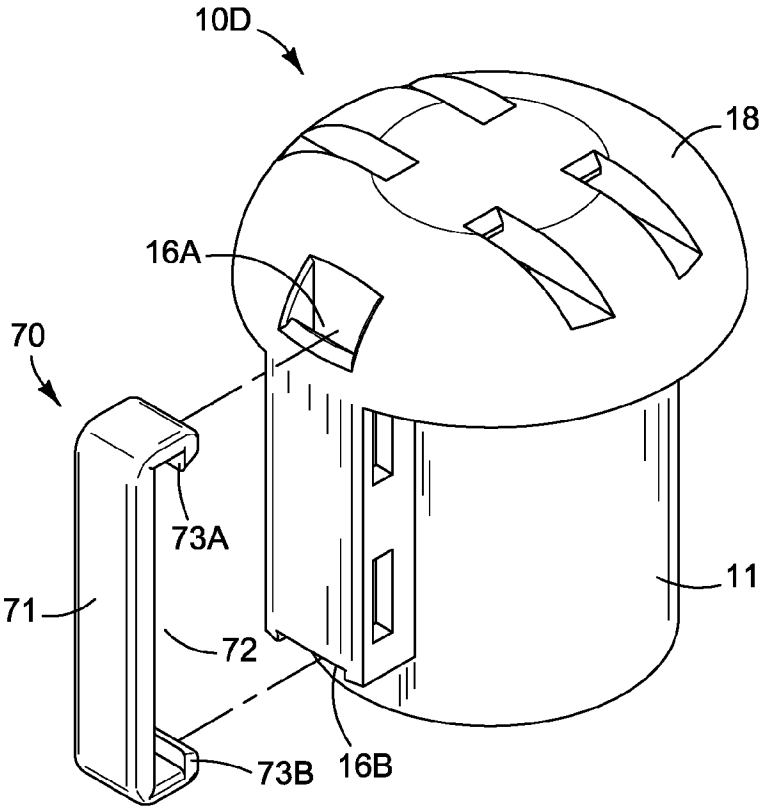
FIG. 10 is a perspective representative view of a modular insulator assembly according to the present invention.

FIGS. 10 and 11 show modular insulator assembly 10D including top-mount insulator body 11 and wide gage tape conductor retainer 70 that includes retainer body 71. Crown portion 18 is formed at and defines the uppermost portion of top-mount insulator body 11. Upper retainer engaging notch 16A and lower retainer engaging notch 16B are formed in top-mount insulator body 11. FIG. 11 shows wide gage tape conductor retainer 70 attached to top-mount insulator body 11. More particularly, upper retainer finger 73A, (shown in FIG. 10), engages upper retainer engaging notch 16A and lower retainer finger 73B, (shown in FIG. 10), engages lower retainer engaging notch 16B to secure retainer body 71 to top-mount insulator body 11. Attachment of retainer body 71 to top-mount insulator body 11 as shown in FIG. 11 creates conductor passage 72 formed between retainer body 71 and top-mount insulator body 11. Conductor passage 72 is configured for passage of a wide gage conductive tape WT, (shown in FIG. 1), configured having a width of up to approximately 5.0 centimeters (two inches).

Figure 13:
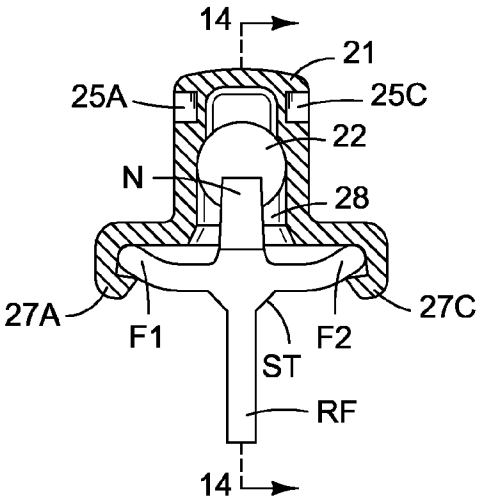
FIG. 13 is a top cutaway representative view of a support passage insulator body according to the present invention.
Figure 12:
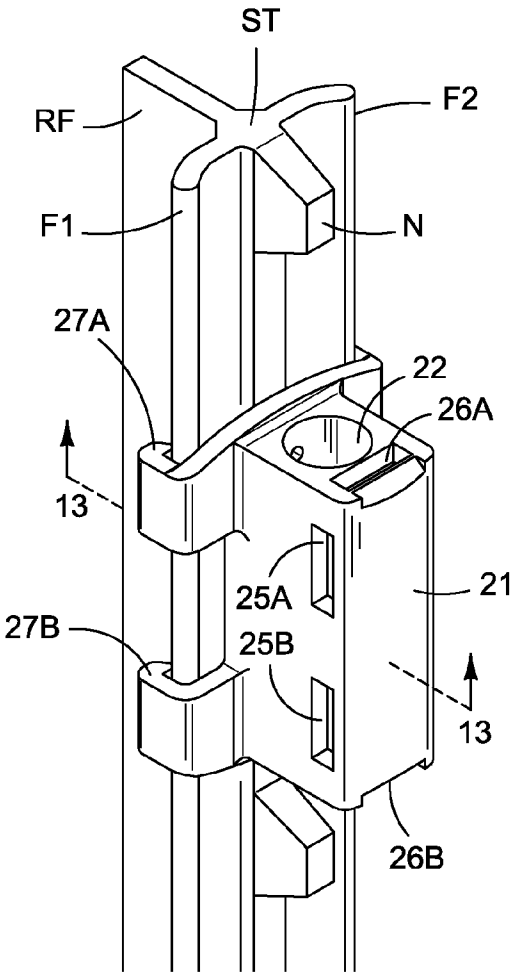
FIG. 12 is a perspective representative view of a support passage insulator body according to the present invention.
Figure 14:
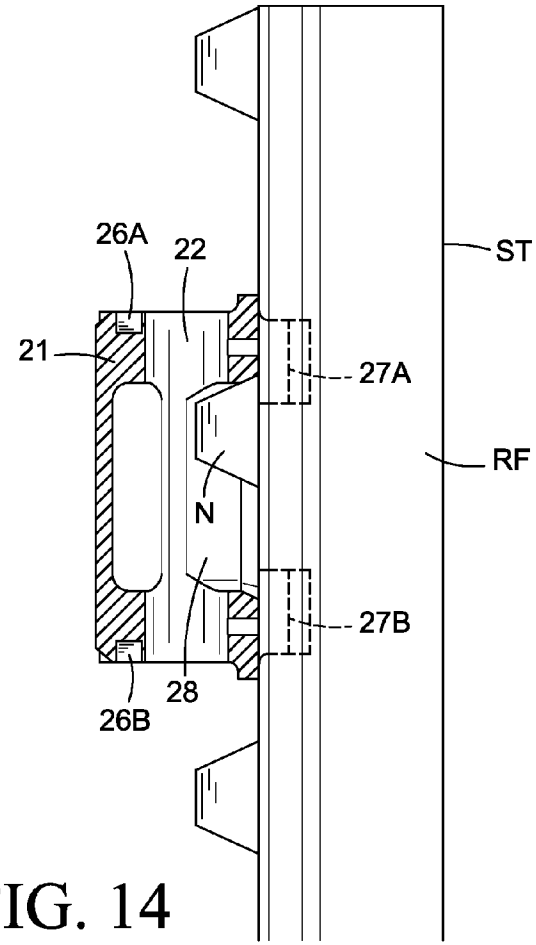
FIG. 14 is a side cutaway representative view of a modular insulator assembly according to the present invention.

FIGS. 12 through 14 show support passage insulator body 21 connected to support member ST. As shown in FIGS. 12 and 13, support member ST includes rear flange RF, first side flange F1, second side flange F2 and a plurality of intermittent nubs N. Support passage insulator body 21 is formed having support member passage aperture 22. Support passage insulator body 21 also includes first side retainer engaging slots 25A and 25B, (shown in FIG. 12), and second side retainer engaging slots 25C and 25D, (shown in FIG. 15). Support passage insulator body 21 includes upper retainer engaging notch 26A and lower retainer engaging notch 26B as shown in FIGS. 12 and 14.

Support passage insulator body 21 includes T-post flange grips 27A and 27B, (shown in FIGS. 12 and 15), and T-post flange grips 27C and 27D, (shown in FIG. 15) arranged in an opposing relationship to T-post flange grips 27A and 27B. To attach support passage insulator body 21 to support member ST, T-post flange grips 27A and 27B are placed over T-post first side flange F1 and T-post flange grips 27C and 27D, (shown in FIG. 15), are placed over T-post second side flange F2. A gripping force is created by opposing T-post flange grips 27A and 27B and T-post flange grips 27C and 27D. Additionally, each T-post flange grips 27A through 27D exerts a gripping force against the side flange about which it is positioned. Nub N of support member ST fits into cavity 28, as shown in FIGS. 13 and 14, prohibiting movement of support passage insulator body 21 in a downward direction along support member ST.

Figure 15:
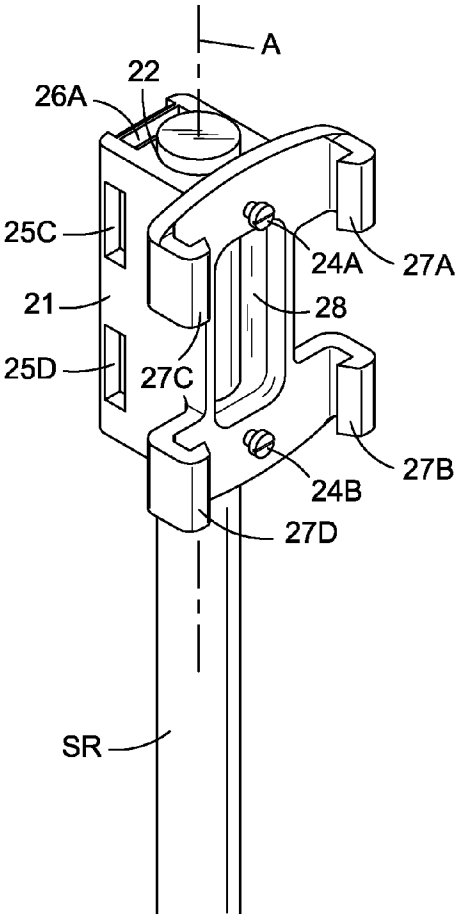
FIG. 15 is a perspective representative view of a support passage insulator body according to the present invention.

FIG. 15 shows support member SR passed through support member passage aperture 22 of support passage insulator body 21 along support member axis A. Support member passage aperture 22 adapted for sliding engagement with circular support member SR while set screws 24A and 24B secure support passage insulator body 21 along the length of support member SR once a desired position for support passage insulator body 21 is established.

Figure 18:
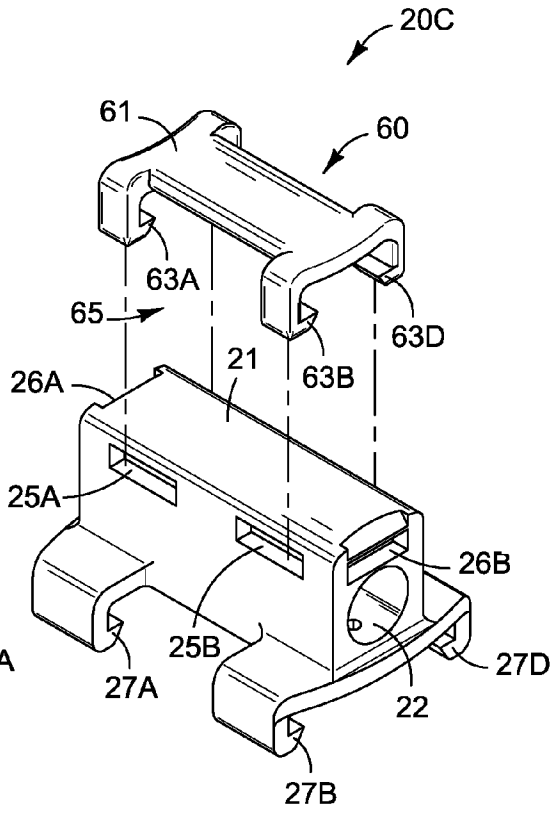
FIG. 18 is a perspective representative view of a modular insulator assembly according to the present invention.
Figure 17:
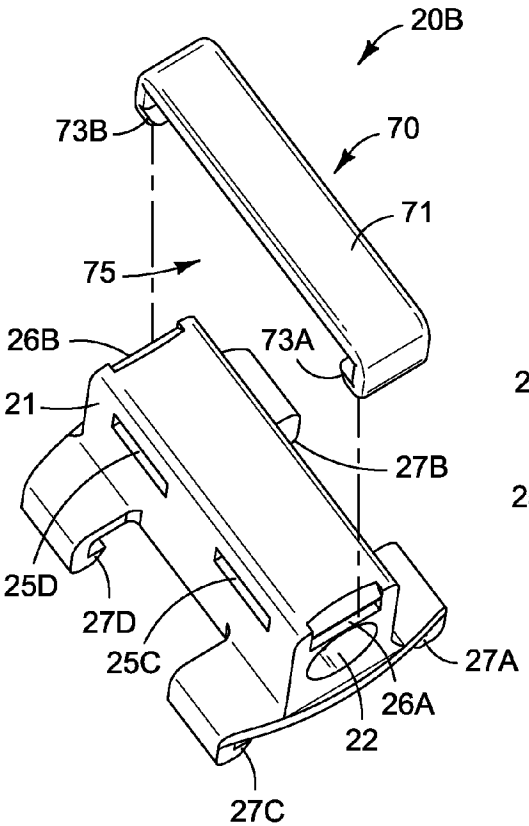
FIG. 17 is a perspective representative view of a modular insulator assembly according to the present invention.
Figure 16:
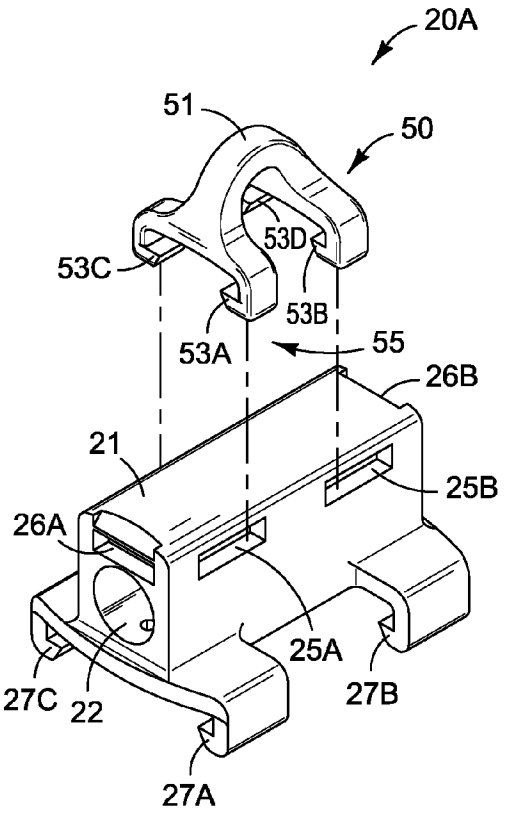
FIG. 16 is a perspective representative view of a support passage insulator body according to the present invention.

FIG. 16 shows modular insulator assembly 20A adapted to support and guide a conductive wire. FIG. 17 shows modular insulator assembly 20B adapted to support and guide a wide gage conductive tape. FIG. 18 shows modular insulator assembly 20C adapted to support and guide a narrow gage conductive tape. Referring to FIGS. 16 through 18, support passage insulator body 21 includes upper retainer engaging notch 26A and lower retainer engaging notch 26B. Support passage insulator body 21 also includes first side retainer engaging slots 25A and 25B, (shown in FIGS. 16 and 18), second side retainer engaging slots 25C and 25D, (shown in FIG. 17) and T-post flange grips 27A and 27B, (shown in FIGS. 16 through 18), and T-post flange grips 27C, (shown in FIGS. 16 and 17) and 27D, (shown in FIGS. 17 and 18).

FIG. 16 shows modular insulator assembly 20A including includes wire conductor retainer 50. Wire conductor retainer 50 includes retainer body 51 having a plurality of retainer fingers 53A, 53B, 53C and 53D. FIG. 16 shows wire conductor retainer 50 attached to support passage insulator body 21. More particularly, retainer fingers 53A, 53B, 53C and 53D, engage first side retainer engaging slots 25A and 25B and second side retainer engaging slots 25C and 25D, (shown in FIG. 17), to secure retainer body 51 to support passage insulator body 21. Attachment of retainer body 51 to support passage insulator body 21 creates conductor passage 55 formed between retainer body 51 and top-mount insulator body 11. Conductor passage 55 is configured for passage of conductive wire W as shown in FIG. 1.

Referring to FIG. 17 modular insulator assembly 20B includes wide gage tape conductor retainer 70 having retainer body 71. Upper retainer finger 73A and lower retainer finger 73B extend from retainer body 71. Wide gage tape conductor retainer 70 is attached support passage insulator body 21 when upper retainer finger 73A engages upper retainer engaging notch 26A and lower retainer finger 73B engages lower retainer engaging notch 26B to secure retainer body 71 to support passage insulator body 21. Attachment of retainer body 71 to top-mount insulator body 11 creates conductor passage 75 formed between retainer body 71 and support passage insulator body 21. Conductor passage 75 is configured for passage of a wide gage conductive tape WT as shown in FIG. 1.

FIG. 18 shows modular insulator assembly 20C including narrow gage tape conductor retainer 60 having retainer body 61. First side fingers 63A, and 63B, (shown in FIG. 18), engage first side retainer engaging slots 25A and 25B, (shown in FIG. 18), and second side fingers 63C, (shown in FIG. 8), and 63D, (shown in FIG. 18), engage second side retainer engaging slots 25C and 25D, (shown in FIG. 17), to secure retainer body 61 to support passage insulator body 21. Attachment of retainer body 61 to support passage insulator body 21 creates conductor passage 65 formed between retainer body 61 and support passage insulator body 21. Conductor passage 65 is configured for passage of a narrow gage conductive tape as shown in FIG. 1.

Figure 19:
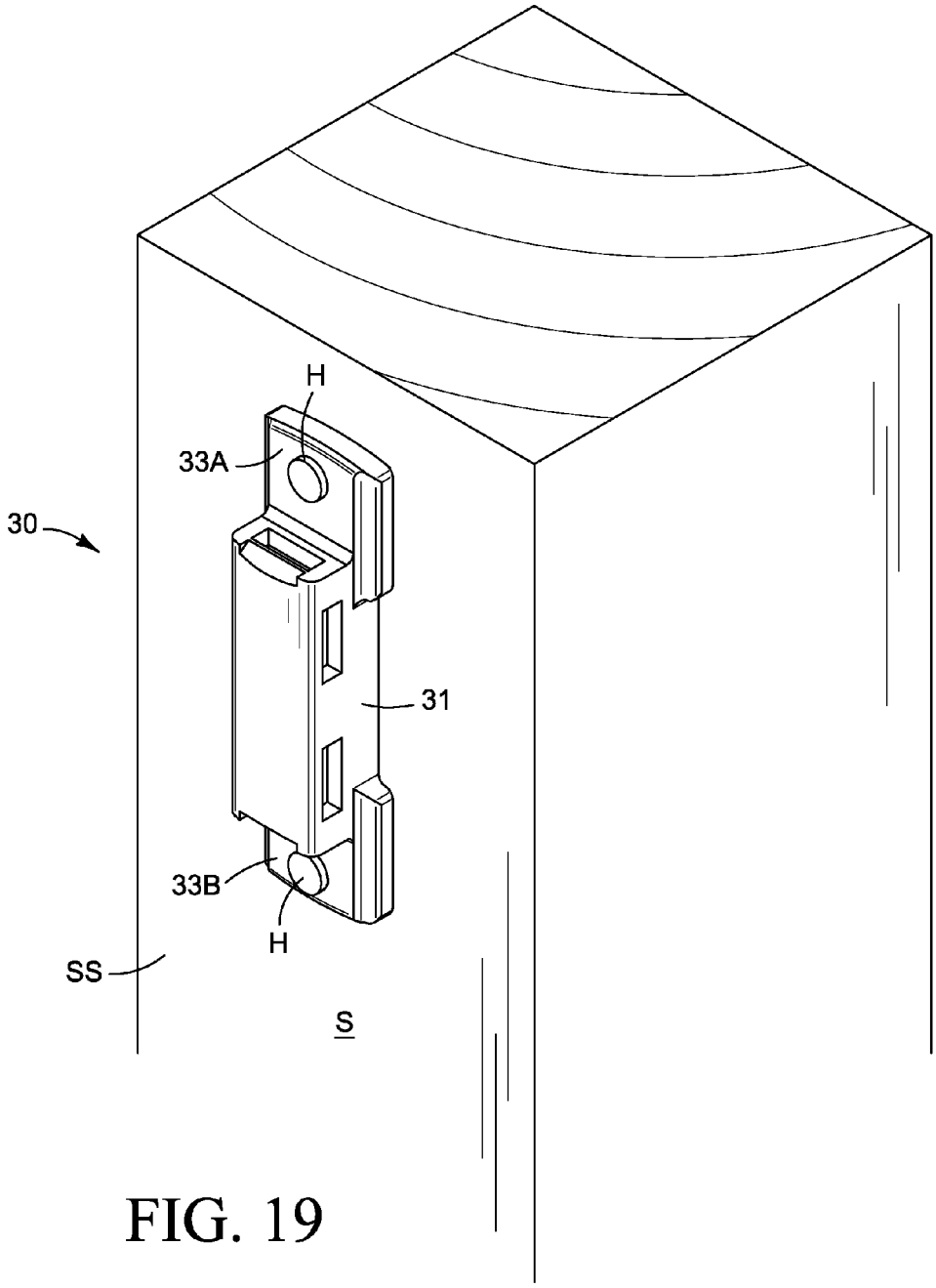
FIG. 19 is a perspective representative view of a surface-mount insulator body according to the present invention.

FIG. 19 shows surface mount insulator body 31 mounted to surface S of support member SS. Surface mount insulator body 31 includes attachment ear 33A and attachment ear 33B. Each attachment ear 33A and 33B includes an aperture, (not shown), through which attachment hardware H is passed in order to connect surface mount insulator body 31 to support member SS.

Figures 20, 21, 22, 23, 24, 25:
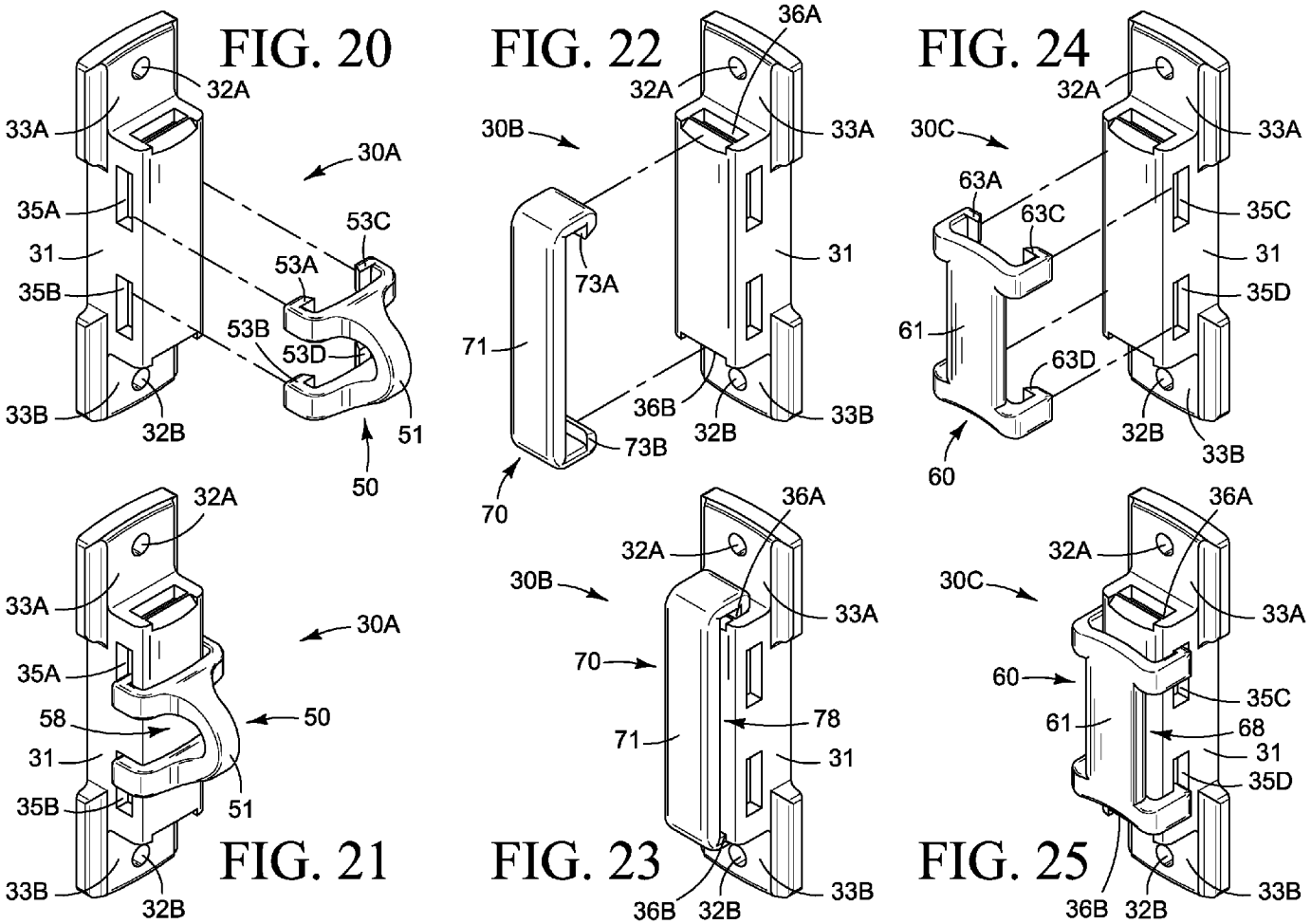
FIG. 20 is a perspective representative view of a modular insulator assembly according to the present invention.
FIG. 21 is a perspective representative view of a modular insulator assembly according to the present invention.
FIG. 22 is a perspective representative view of a modular insulator assembly according to the present invention.
FIG. 23 is a perspective representative view of a modular insulator assembly according to the present invention.
FIG. 24 is a perspective representative view of a modular insulator assembly according to the present invention.
FIG. 25 is a perspective representative view of a modular insulator assembly according to the present invention.

Referring to FIGS. 20 through 25, surface mount insulator body 31 is shown in combination with various conductor retainers, wire conductor retainer 50, FIGS. 20 and 21, wide gage tape conductor retainer 70, FIGS. 22 and 23 and narrow gage tape conductor retainer 60, FIGS. 24 and 25 creating modular insulator assemblies 30A, 30B and 30C respectively. Surface mount insulator body 31 is shown in FIGS. 20 through 25 including attachment ear 33A including insulator attachment aperture 32A and attachment ear 33B including insulator attachment aperture 32B.

FIGS. 20 and 21 show modular insulator assembly 30A including wire conductor retainer 50 attachable to surface mount insulator body 31. More particularly, retainer fingers 53A, 53B, 53C and 53D, (shown in FIG. 20), are configured to engage with retainer engaging detents 35A and 35B, (shown in FIG. 20), and retainer engaging detents 35C and 35D, (shown in FIG. 22), to secure wire conductor retainer 50 to surface mount insulator body 31. The combined configuration of modular insulator assembly 30A and wire conductor retainer 50 creates conductor passage 58, (shown in FIG. 21), formed between retainer body 51 and surface mount insulator body 31. Conductor passage 58 is configured for passage of a conductive wire W as shown in FIG. 1.

FIGS. 22 and 23 show modular insulator assembly 30B including wide gage tape conductor retainer 70 attachable to surface mount insulator body 31. More particularly, upper retainer finger 73A, (shown in FIG. 22), is configured to engage upper retainer engaging notch 36A and lower retainer finger 73B, (shown in FIG. 22), is configured to engage lower retainer engaging notch 36B to secure retainer body 71 to surface mount insulator body 31. Attachment of retainer body 71 to surface mount insulator body 31 as seen in FIG. 23, creates conductor passage 78 formed between retainer body 71 and surface mount insulator body 31. Conductor passage 78 is configured for passage of a wide gage conductive tape WT as shown in FIG. 1.

FIGS. 24 and 25 show modular insulator assembly 30C including narrow gage tape conductor retainer 60 having retainer body 61 attachable to surface mount insulator body 31. First side fingers 63A, (shown in FIG. 24), and 63B, (shown in FIG. 18), engage first side retainer engaging slots 35A and 35B, (shown in FIG. 20), and second side fingers 63C and 63D, (shown in FIG. 24), engage second side fingers 63C and 63D, (shown in FIGS. 24 and 25), to secure retainer body 61 to surface mount insulator body 31. Attachment of retainer body 61 to surface mount insulator body 31 creates conductor passage 68 formed between retainer body 61 and surface mount insulator body 31. Conductor passage 68 is configured for passage of a narrow gage conductive tape.

Figure 26:
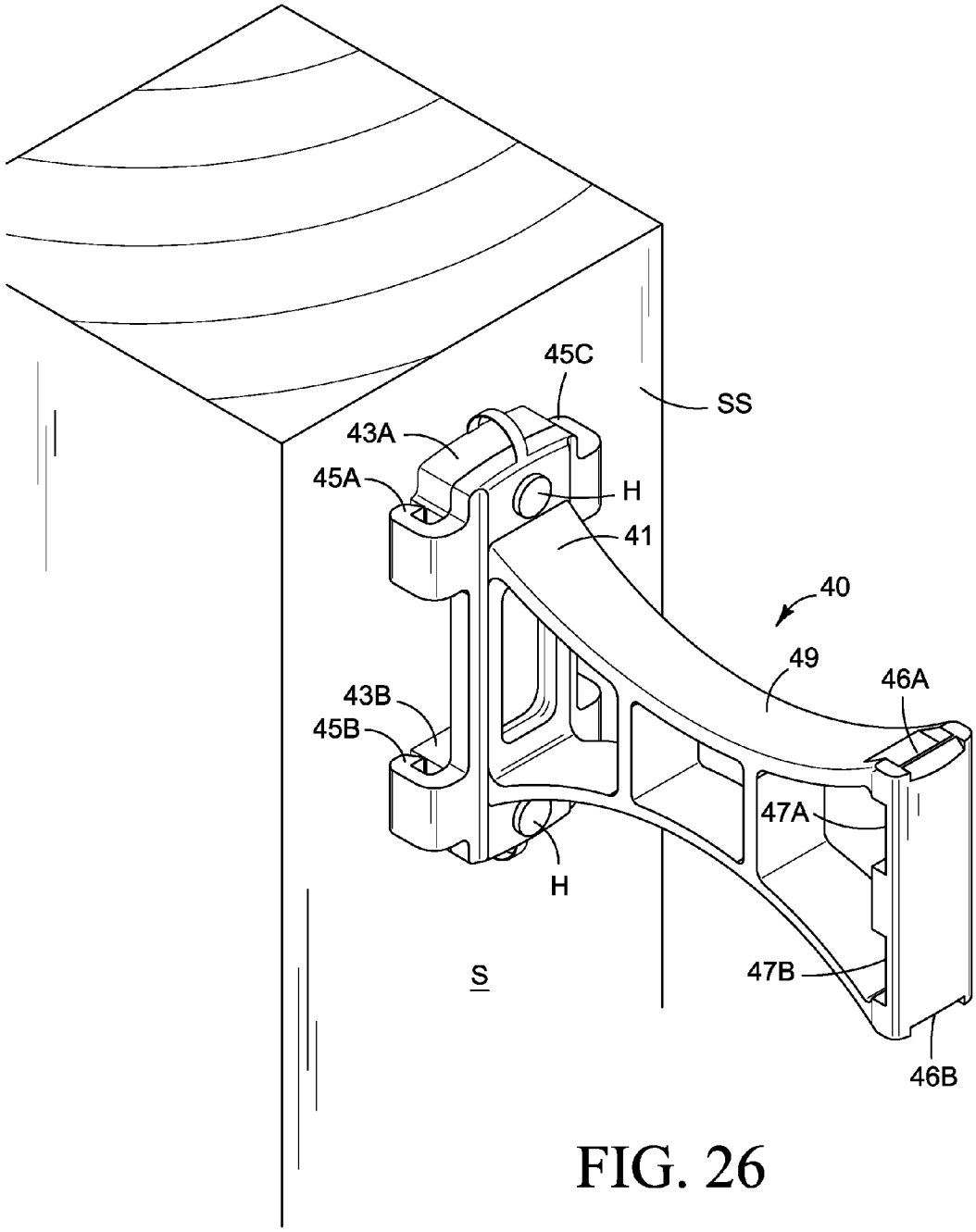
FIG. 26 is a perspective representative view of a modular insulator assembly including a combination surface-mount/support passage insulator body according to the present invention.

FIGS. 26 through 30 show combination surface/T-post mount insulator 40 including combination surface/T-post mount insulator body 41. Combination surface/T-post mount insulator body 41 includes neck section 49 that permits offsetting a conductor a selected distance from a support member by selection of an insulator body having a neck of a desired length. Combination surface/T-post mount insulator body 41 also includes insulator attachment apertures 42A and 42B through which attachment hardware may be inserted to attach combination surface/T-post mount insulator body 41 to a surface as shown in FIG. 26.

FIG. 26 shows combination surface/T-post mount insulator body 41 readily adaptable for mounting to surface S of support member SS employing attachment hardware H with spacers 43A and 43B located between combination surface/T-post mount insulator body 41 and surface S of support member SS. Alternately, as shown in FIG. 27, combination surface/T-post mount insulator body 41 is adaptable for attachment to support member ST, with spacers 43A and 43B removed and therefore not shown in FIG. 27.

Figure 27:
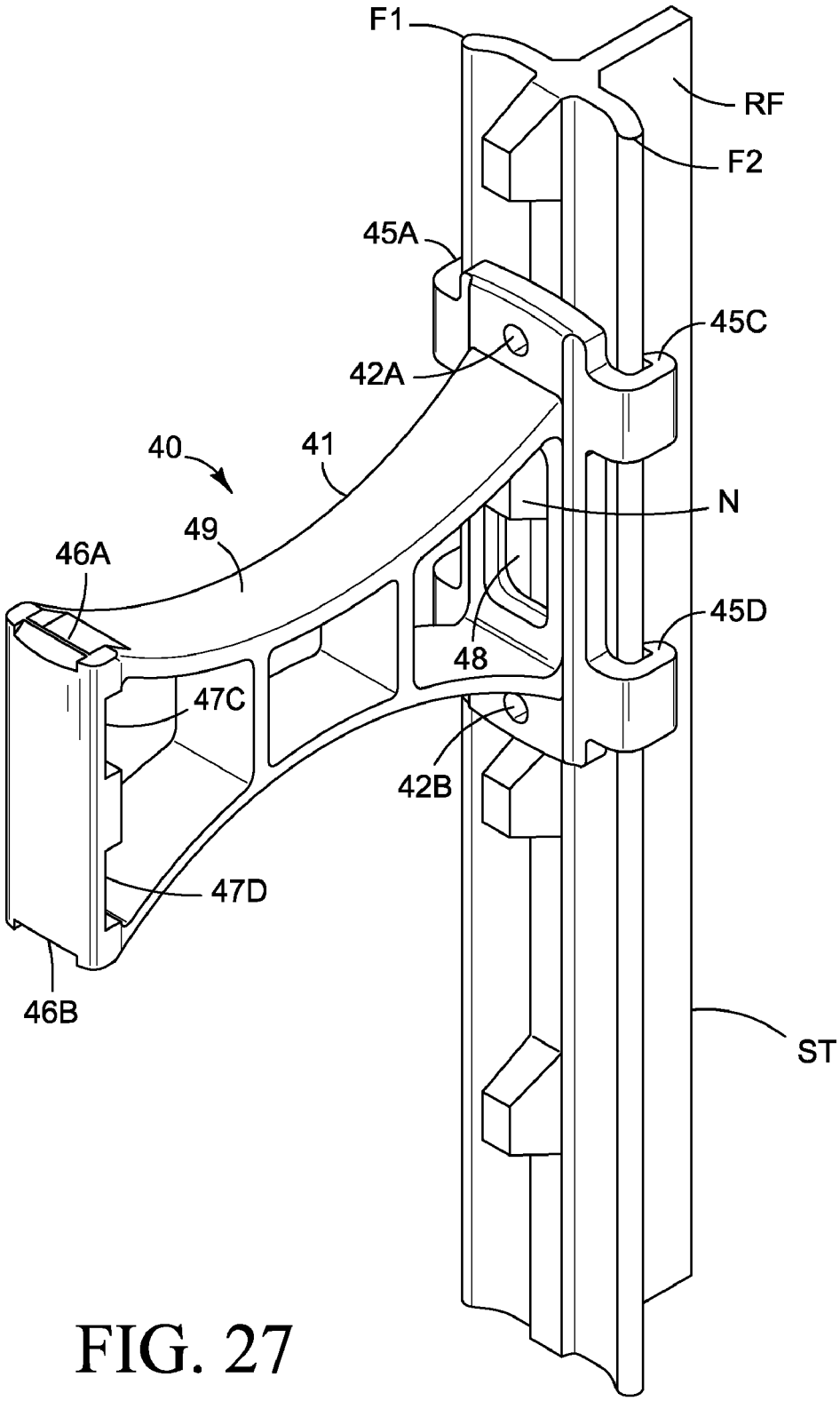
FIG. 27 is a perspective representative view of a modular insulator assembly including a combination surface-mount/support passage insulator body according to the present invention.

Referring to FIG. 27, to attach combination surface/T-post mount insulator body 41 to support member ST, T-post flange grip 45A, (shown in FIGS. 26, 27, 29 and 30), and T-post flange grip 45B, (shown in FIGS. 26, 29 and 30) are placed over T-post first side flange F1 and T-post flange grips 45C and 45D, (shown in FIG. 27), are placed over T-post second side flange F2. Nub N fits into cavity 48, as shown in FIG. 27 which prohibits movement of combination surface/T-post mount insulator body 41 in a downward direction along support member ST.

Figure 28:
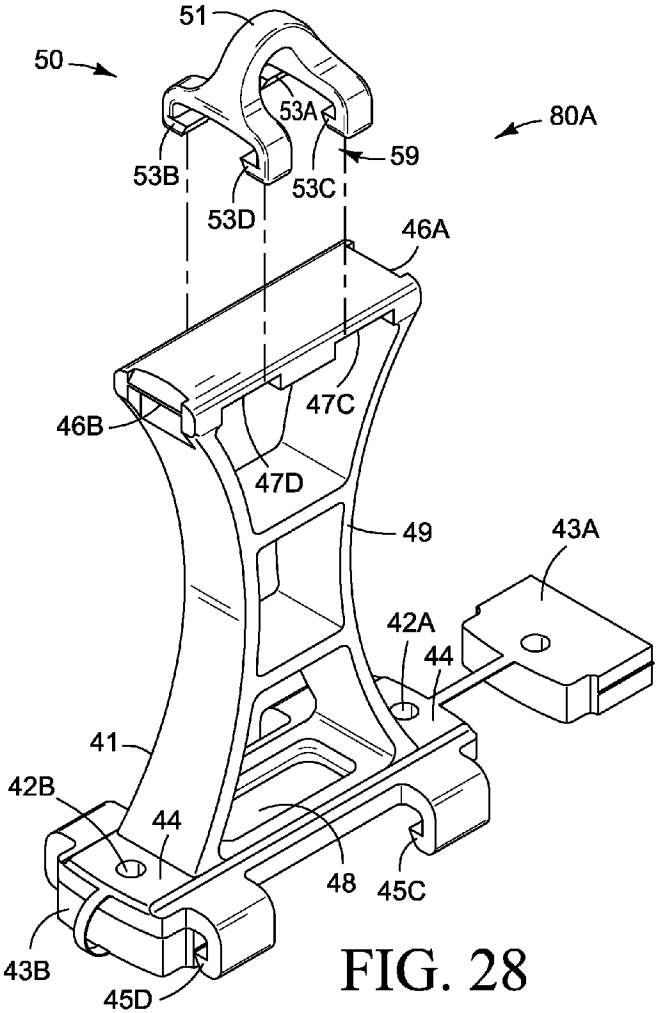
FIG. 28 is a perspective representative view of a modular insulator assembly including a combination surface-mount/support passage insulator body according to the present invention.

Referring to FIGS. 26, 27, 28 and 30, combination surface/T-post mount insulator body 41 also includes first side retainer engaging slots 47A and 47B, (shown in FIGS. 26, 29 and 30) and second side retainer engaging slots 47C and 37D, (shown in FIGS. 27 and 28). As shown in FIGS. 26 through 30, surface mount insulator body 31 also includes upper retainer engaging notch 46A and lower retainer engaging notch 46B.

Figure 29:
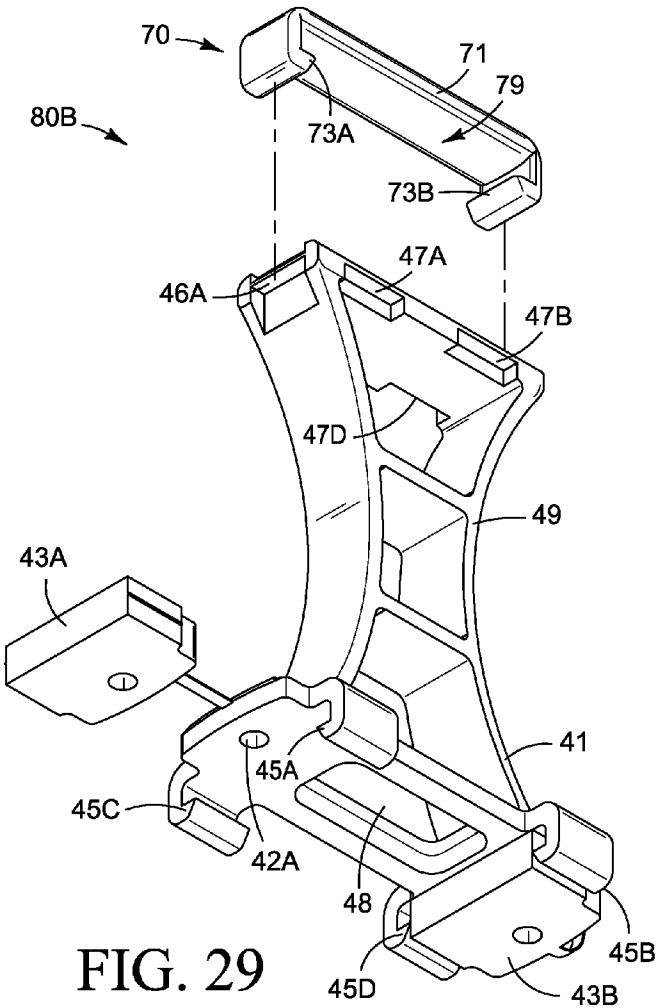
FIG. 29 is a perspective representative view of a modular insulator assembly including a combination surface-mount/support passage insulator body according to the present invention.
Figure 30:
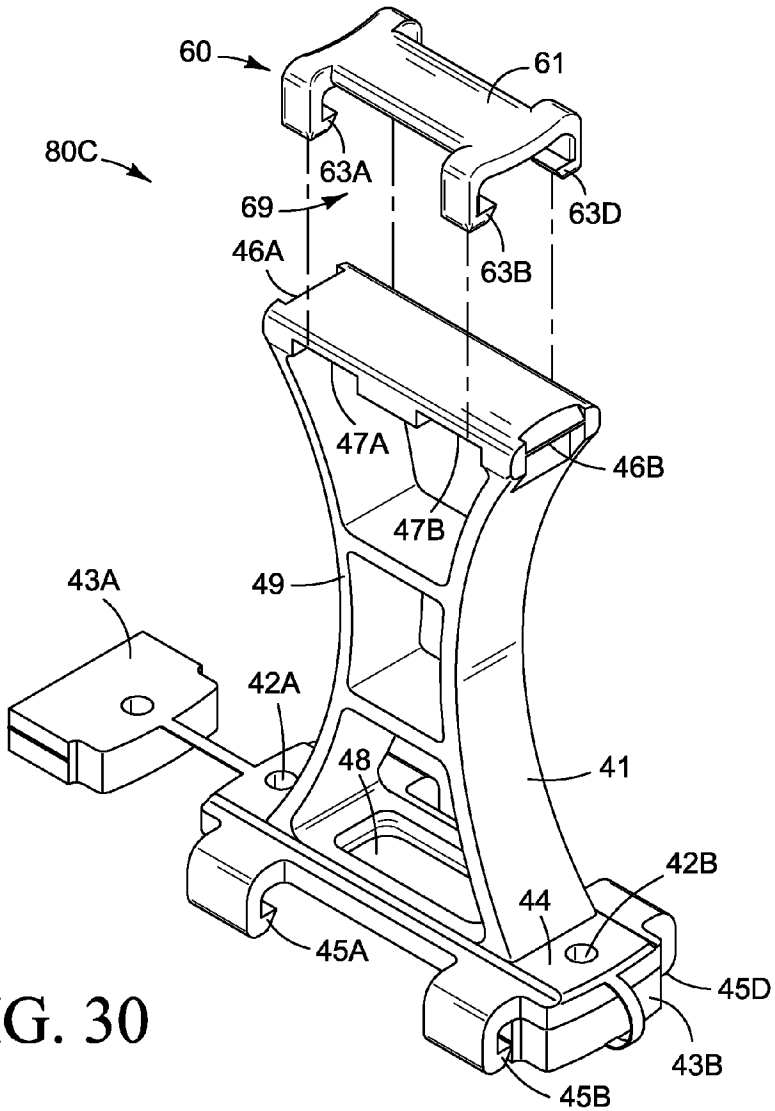
FIG. 30 is a perspective representative view of a modular insulator assembly including a combination surface-mount/support passage insulator body according to the present invention.

FIGS. 28 through 30 show combination surface/T-post mount insulator body 41 combined with various conductor retainers, wire conductor retainer 50, FIG. 28, wide gage tape conductor retainer 70, FIG. 29 and narrow gage tape conductor retainer 60, FIG. 30 creating modular insulator assemblies 80A, 80B and 80C respectively. FIGS. 28 through 30 show spacers 43A and 43B which may be left attached to combination surface/T-post mount insulator body 41 as indicated by the position of spacer 43B when connecting combination surface/T-post mount insulator body 41 to a T-post as seen in FIG. 27 or they may be inserted below combination surface/T-post mount insulator body 41 as indicated by the position of spacer 43B to facilitate surface mounting as seen in FIG. 26.

Referring to FIG. 28, modular insulator assembly 80A includes wire conductor retainer 50 attachable to combination surface/T-post mount insulator body 41. More particularly, retainer fingers 53A, 53B, are configured to engage retainer engaging detents 47A and 47B, (shown in FIG. 29), and retainer fingers 53C and 53D are configured to engage retainer engaging detents 47C and 47D, (shown in FIG. 28), to secure wire conductor retainer 50 to combination surface/

T-post mount insulator body 41. The combined configuration creates conductor passage 59, (shown in FIG. 28), formed between retainer body 51 and combination surface/T-post mount insulator body 41. Conductor passage 59 is configured for passage of a conductive wire.

FIG. 29 shows modular insulator assembly 80B including wide gage tape conductor retainer 70 having retainer body 71. Wide gage tape conductor retainer 70 is removably attachable to combination surface/T-post mount insulator body 41. More particularly, upper retainer finger 73A engages upper retainer engaging notch 46A and lower retainer finger 73B engages lower retainer engaging notch 46B, (shown in FIG. 28), to secure retainer body 71 to combination surface/T-post mount insulator body 41. Attachment of to retainer body 71 to combination surface/T-post mount insulator body 41 creates conductor passage 79 formed between retainer body 71 and combination surface/T-post mount insulator body 41. Conductor passage 79 is configured for passage of a wide gage conductive tape.

FIG. 30 shows modular insulator assembly 80C including narrow gage tape conductor retainer 60 having retainer body 61. Narrow gage tape conductor retainer 60 is removably attachable to combination surface/T-post mount insulator body 41. More particularly, first side fingers 63A and 63B, are configured to engage first side retainer engaging slots 47A and 47B and second side fingers 63C, and 63D, (shown in FIG. 8), are configured to engage second side retainer engaging slots 47C and 47D, (shown in FIG. 28), to secure retainer body 61 to combination surface/T-post mount insulator body 41. Attachment of retainer body 61 to combination surface/T-post mount insulator body 41 creates conductor passage 69 formed between retainer body 61 and combination surface/T-post mount insulator body 41. Conductor passage 69 is configured for passage of a narrow gage conductive tape.

Figure 31:
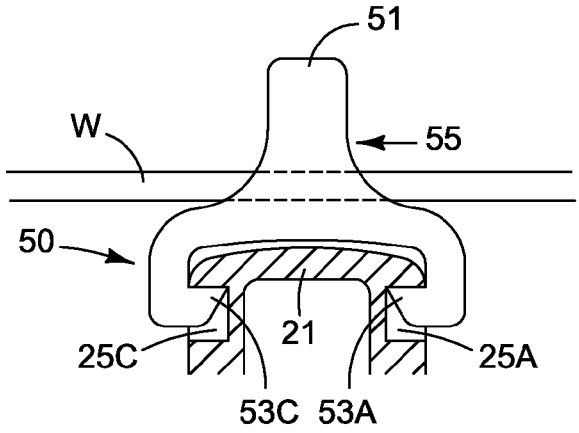
FIG. 31 is a representative top cutaway view of a modular insulator assembly including a bare conductive wire retainer according to the present invention.
Figure 32:
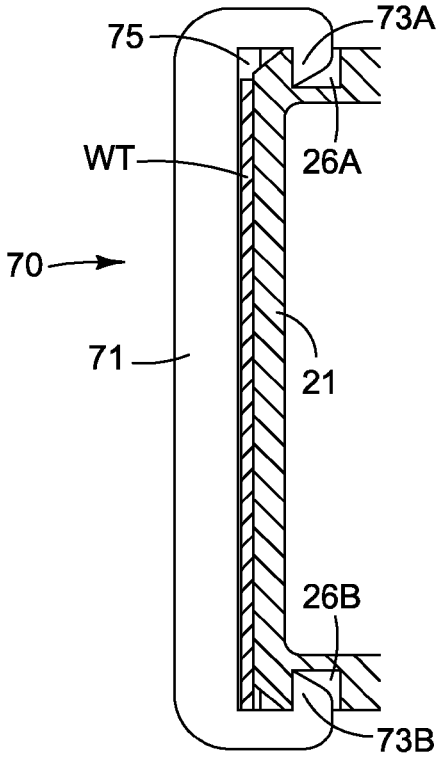
FIG. 32 is a representative side cutaway view of a modular insulator assembly including a wide gage conductive tape retainer according to the present invention.
Figure 33:
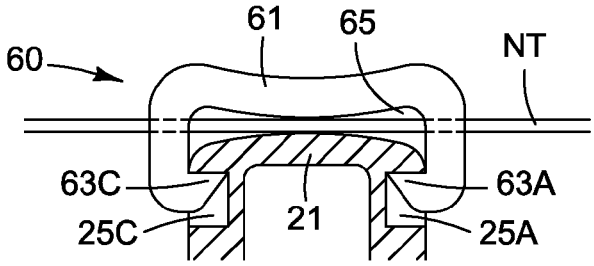
FIG. 33 is a representative top cutaway view of a modular insulator assembly including a narrow gage conductive tape retainer according to the present invention.

FIGS. 31 through 33 are details illustrating more closely the insulator body engagement element of the conductor retainer body and the conductor retainer engagement element of the insulator body that are removably engageable with each other to connect the conductor retainer to the insulator body to form a conductor passage between the conductor retainer and the insulator body. More particularly, FIG. 31 is a top partial sectional detailed elevation showing wire conductor retainer 50 including retainer body 51 attached to insulator body 21. Retainer finger 53A is seen engaging first side retainer engaging slot 25A and retainer finger 53C is shown engaging second side retainer engaging slot 25B. As shown in FIG. 31, the combined configuration creates conductor passage 55 formed between retainer body 51 and insulator body 21. Conductor passage 55 is configured for passage of a conductive wire W.

FIG. 32 is a side partial sectional detailed elevation showing wide gage tape retainer 70 including retainer body 71 attached to insulator body 21. More particularly, upper retainer finger 73A engages upper retainer engaging notch 26A and lower retainer finger 73B engages lower retainer engaging notch 26B to secure retainer body 71 to insulator body 21. Attachment of to retainer body 71 to combination body 21 creates conductor passage 75 formed between retainer body 71 and insulator body 21. Conductor passage 75 is configured for passage of wide gage conductive tape WT.

FIG. 33 is a top partial sectional detailed elevation showing narrow gage tape conductor retainer 60 having retainer body 61 attached to insulator body 21. More particularly, first side finger 63A is shown engaging first side retainer engaging slot 25A and second side finger 63C is shown engaging second side retainer engaging slot 25C, to secure retainer body 61 to support passage insulator body 21. Attachment of retainer body 61 to support passage insulator body 21 creates conductor passage 65 formed between retainer body 61 and support passage insulator body 21. Conductor passage 65 is configured for passage of a narrow gage conductive tape NT.

Referring again to FIG. 1, in use, modular insulator assembly system 100 provides the flexibility and advantage of allowing a user a choice of insulators depending on the user's chosen support member or combination of support members including support member ST, (T-post), support member SR, (a rod), or surface mount support member SS, (a wood post or other surface). Modular insulator assembly system 100 also permits the flexibility and advantage of allowing a user a choice of using any of a number of conductors with the referenced insulators including a wire conductor retainer 50, shown in FIG. 31, a wide gage conductive tape retainer 70, shown in FIG. 32 or a narrow gage conductive tape retainer 60, shown in FIG. 3. The ability to interchange insulators and retainers adapting the component parts of the system for use with various conductors and support member as describe d herein is advantageous not only to the user of modular insulator assembly system 100 but to the seller as well, as less shelf or storage space will need to be dedicated to parts that may be combined in a variety of ways to provide the flexibility and advantages described.

While the invention has been described in connection with the preferred embodiment, it is not intended to limit the scope of the invention to the particular form set forth, but, on the contrary, it is intended to cover such alternatives, modifications and equivalents as may be included within the spirit and scope of the invention as defined by the appended claims.

What is claimed is:

1. A modular insulator assembly for attaching a conductor to a support member, the modular insulator assembly comprising:

an insulator body attachable to the support member, the insulator body including a retainer engagement slot;

a conductor retainer attachable to the insulator body, the conductor retainer including a retainer body including a finger, the finger engageable with the retainer engagement slot to secure the conductor retainer to the insulator body; and a conductor passage located between the conductor retainer and the insulator body.

2. The modular insulator assembly of claim 1 wherein the insulator body further comprises means for attaching the insulator body to the support member.

3. The modular insulator assembly of claim 2 wherein the means for attaching the insulator body to the support member further comprises at least two opposing support member gripping elements attached to the insulator body, the at least two opposing support member gripping elements adapted to grip the support member.

4. The modular insulator assembly of claim 1 wherein the insulator body further comprises a support member connection aperture configured to permit insertion of the support member into the insulator body.

5. The modular insulator assembly of claim 1 wherein the insulator body further comprises at least two retainer engagement slots and the retainer body further comprising at least two fingers attached to and extending from the retainer body, the at least two fingers engageable with the at least two retainer engagement slots.

6. The modular insulator assembly of claim 1 wherein the insulator body further comprises a plurality of retainer engagement slots and the retainer body further comprising a plurality of fingers attached to and extending from the retainer body, one of the plurality of fingers engageable with one of the plurality of engagement slots.

7. A modular insulator assembly for attaching a conductor to a support member, the modular insulator assembly comprising:

an insulator body including a retainer engagement slot, the insulator body including means for attaching the insulator body to the support member;

a conductor retainer including a retainer body attachable to the insulator body, the retainer body including a finger, the finger engageable with the retainer engagement slot to secure the conductor retainer to the insulator body; and a conductor passage located between the conductor retainer and the insulator body.

8. The modular insulator assembly of claim 7 wherein the insulator body further comprises an axis and the means for attaching the insulator body to the support member further comprises a support member connection aperture formed substantially parallel to the axis, the support member connection aperture configured to permit insertion of the support member into the insulator body.

9. The modular insulator assembly of claim 7 wherein the means for attaching the insulator body to the support member further comprises at least two opposing support member gripping elements attached to the insulator body, the at least two opposing support member gripping elements adapted to grip the support member.

10. The modular insulator assembly of claim 7 wherein the insulator body further comprises at least two retainer engagement slots and the retainer body further comprising at least two fingers attached to and extending from the retainer body, the at least two fingers engageable with the at least two retainer engagement slots.

11. The modular insulator assembly of claim 7 wherein the insulator body further comprises a plurality of retainer engagement slots and the retainer body further comprising a plurality of fingers attached to and extending from the retainer body, one of the plurality of fingers engageable with one of the plurality of engagement slots.

12. A modular insulator system for attaching a conductor to a support member, the modular insulator assembly system comprising:

an insulator body selected from a group of insulator bodies including a top-mount insulator body, a support passage insulator body, an extended neck insulator body and a surface mount insulator body, each of said insulator bodies attachable to the support member, each of said insulator bodies including a retainer engagement slot;

a conductor retainer selected from a group of conductor retainers including a bare conductive wire retainer, a narrow gage conductive tape retainer and a wide gage conductive tape retainer, each of said conductor retainers including a retainer body including a finger, the finger engageable with the retainer engagement slot to secure one of said conductor retainers to one of said selected insulator bodies; and a conductor passage formed between the conductor retainer body and the insulator body.

13. The modular insulator system of claim 12 wherein each of the insulator bodies further comprise means for attaching one of the insulator bodies to the support member.

14. The modular insulator system of claim 12 wherein each of the insulator bodies further comprise at least two retainer engagement slots, each of the conductor retainers further comprising at least two fingers attached to and extending from each of conductor retainers of the group of conductor retainers, the at least two fingers engageable with the at least two retainer engagement slots.

* * * * *